US009048078B2

(12) United States Patent
Kalinitchenko

(10) Patent No.: US 9,048,078 B2
(45) Date of Patent: Jun. 2, 2015

(54) MASS SPECTROMETRY

(71) Applicant: Bruker Chemical Analysis BV, Goes (NL)

(72) Inventor: Iouri Kalinitchenko, Berwick (AU)

( * ) Notice: Subject to any disclaimer, the term of this patent is extended or adjusted under 35 U.S.C. 154(b) by 0 days.

(21) Appl. No.: 14/366,078

(22) PCT Filed: Dec. 21, 2012

(86) PCT No.: PCT/AU2012/001590

§ 371 (c)(1),
(2) Date: Jun. 17, 2014

(87) PCT Pub. No.: WO2013/091019

PCT Pub. Date: Jun. 27, 2013

(65) Prior Publication Data

US 2014/0319366 A1 Oct. 30, 2014

(30) Foreign Application Priority Data

Dec. 22, 2011 (AU) ..... 2011905387

(51) Int. Cl.

| | |
|---|---|
| ***H01J 49/06*** | (2006.01) |
| ***H01J 49/26*** | (2006.01) |
| ***H01J 49/00*** | (2006.01) |
| ***H01J 49/22*** | (2006.01) |

(52) U.S. Cl.

CPC ..... *H01J 49/061* (2013.01); *H01J 49/22* (2013.01); *H01J 49/067* (2013.01)

(58) Field of Classification Search

CPC ..... H01J 49/067; H01J 49/06; H01J 49/061; H01J 49/22

USPC ..... 250/396 R, 281, 282, 287, 288; 313/361.1

See application file for complete search history.

(56) References Cited

U.S. PATENT DOCUMENTS

| | | | | |
|---|---|---|---|---|
| 5,464,985 | A | 11/1995 | Cornish et al. | |
| 5,614,711 | A | 3/1997 | Li et al. | |
| 5,696,375 | A | 12/1997 | Park et al. | |
| 5,756,993 | A * | 5/1998 | Yoshinari et al. | 250/281 |
| 6,040,575 | A * | 3/2000 | Whitehouse et al. | 250/288 |
| 8,134,119 | B2 * | 3/2012 | Panayi | 250/281 |
| 2002/0100870 | A1 * | 8/2002 | Whitehouse et al. | 250/281 |
| 2010/0006752 | A1 | 1/2010 | Panayi | |

FOREIGN PATENT DOCUMENTS

WO 98/00224 A1 1/1998

OTHER PUBLICATIONS

Scherer, S. et al., "A novel principle for an ion mirror design in time-of-flight mass spectrometry," Elsevier, International Journal of Mass Spectrometry 251 (2006), pp. 73-81, Published Feb. 17, 2006.

* cited by examiner

*Primary Examiner* — Nikita Wells
(74) *Attorney, Agent, or Firm* — ROBIC, LLP

(57) ABSTRACT

There is provided an ion reflector for use with a mass spectrometer for directing a flow of ions between two distinct axes of travel. The reflector includes an electric field capable of causing a flow of ions focused through a first spatial region to be focused toward a second spatial region, whereby the first and second spatial regions are aligned with respective axes of travel.

20 Claims, 16 Drawing Sheets

MASS SPECTROMETRY

FIELD OF THE INVENTION

The present invention concerns improvements in or relating to mass spectrometry. More particularly, in one aspect, the invention relates to improvements to an ion reflector arrangement for use with mass spectrometry apparatus.

BACKGROUND OF THE INVENTION

In this specification, where a document, act or item of knowledge is referred to or discussed, this reference or discussion is not an admission that the document, act or item of knowledge or any combination thereof was at the priority date part of common general knowledge, or known to be relevant to an attempt to solve any problem with which this specification is concerned.

Mass spectrometers are specialist devices used to measure or analyse the mass-to-charge ratio of charged particles for the determination of the elemental composition of a sample or molecule containing the charged particles.

A number of different techniques are used for such measurement purposes. One form of mass spectrometry involves the use of an inductively coupled plasma (ICP) torch for generating a plasma field into which a sample to be measured or analysed is introduced. In this form, the plasma vaporises and ionizes the sample so that ions from the sample can be introduced to a mass spectrometer for measurement/analysis (spectrometric analysis).

As the mass spectrometer requires a vacuum in which to operate, the extraction and transfer of ions from the plasma involves a fraction of the ions formed by the plasma passing through an aperture of approximately 1 mm in size provided in a sampler, and then through an aperture of approximately 0.4 mm in size provided in a skimmer (typically referred to as sampler and skimmer cones respectively).

Guidance of the ion beam through a mass spectrometer apparatus is generally controlled via shaped electric fields provided by suitably positioned electrodes which operate at controlled voltages. Arrangements of this type are normally referred to as ion optics systems.

A typical example of a well known ion optics system is that described in U.S. Pat. No. 6,614,021 (to Varian Australia Pty Ltd). However, although the arrangement described in US'021 operates sufficiently, there are some deficiencies which limit its measurement sensitivity at some ion energy levels.

SUMMARY OF THE INVENTION

According to one principal aspect of the present invention, there is provided an ion reflector for modifying the path of travel of a beam of ions in a mass spectrometer, the reflector including an electric field inducer to reflect ions travelling in a first spatial region from a first focal point in said first spatial region to a second focal point in a second spatial region by applying an electric field to the ions.

According to another principal aspect of the present invention, there is provided an ion reflector for modifying the path of travel of a beam of ions in a mass spectrometer, the reflector including focusing means for focusing, at a first focal point in a first spatial region, ions travelling in said first spatial region from an ion source, and an electric field inducer for reflecting the ions towards a second focal point in a second spatial region by applying an electric field to the ions.

According to another principal aspect of the present invention, there is provided an ion reflector for modifying the path of travel of a beam of ions in a mass spectrometer, the reflector including focusing means for focusing, at a first focal point in a first spatial region, ions travelling in said first spatial region from an ion source, and an electric field inducer for reflecting the ions from one or more incident angles towards a second focal point in a second spatial region by applying an electric field to the ions.

According to another principal aspect of the present invention, there is provided an ion reflector for use with a mass spectrometer for directing a flow of ions between two distinct axes of travel, the reflector including an electric field capable of causing a flow of ions focused toward a first spatial region to be focused toward a second spatial region, whereby the first and second spatial regions are aligned with respective axes of travel of said ions.

For the above described principal aspect of the invention, and those which follow, the first spatial region is representative of a first region of space toward which the flow of ions is focused or concentrated (ie. a first focal point) such that the ionic flux flowing substantially through the first region of space is maximized and the energy distribution of the ion beam is minimized within that region. The first spatial region is often provided at or near an inlet region through which ions to be sampled or measured by the mass spectrometer are extracted from an appropriate ion source.

Preferably, the flow of ions can be concentrated or focused toward the first spatial region by any ion thermalising device such as an ion funnel, ion guide or any other device employing residual pressure collision cooling or collisional focusing functionality. In this manner, a beam of ions extracted from the ion source can be focused or concentrated so that its passes substantially through the first region of space.

The second spatial region generally represents a second region of space toward which ions passing through the first region of space are focused or concentrated (ie. a second focal point) by way of the electric field arrangement. The second region of space is often provided at or near the entrance of a mass analyzer or collisional cell arrangement being a component part of the overall configuration of the mass spectrometer apparatus. In one embodiment, the arrangement of the electric field is such that the concentration of the ionic flux through the second partial region is substantially the same as the ionic flux through the first spatial region. In one respect, the electric field arrangement is configured so that the ionic flux through the first spatial region is mirrored at the second spatial region. Put another way, the shape of the electric field is arranged so that the ion concentration at the first spatial region is mirrored, by way of reflection due to the electric field, at the second spatial region. Preferably, the shape of the electric field is ellipsoidal.

Typically, the second spatial region is spatially distinct from the first spatial region, whereby the positional relationship between both spatial regions is a function of the specific configuration of the electric field arrangement. In one embodiment, the electric field is arranged so that the second spatial region is spaced sufficiently from the first spatial region so that the ions are reflected between the first and second axes of travel of said ions.

Preferably, the electric field is arranged so that the position of the second spatial region, and therefore the direction of flow of the ions, is predetermined.

It will be appreciated that the relative angle between the first and second axes of travel can vary depending upon the mass spectrometry arrangement desired. For example, reflection of the ion beam has been found to increase the measurement sensitivity of a mass spectrometer by reflecting only the target ions, thereby removing undesirable particles from the ion beam stream. Such arrangements may therefore avoid the need for collision or reaction cells which generally seek, by way of providing a collisional atmosphere, to improve the target ion density. In addition, the ability to manipulate or steer the ion beam can allow designers flexibility in developing mass spectrometer devices which are more compact and take up less bench space.

In one embodiment, the electric field may be arranged so that the ions are reflected between first and second axes of travel aligned 90 degrees from one another.

The electric field arrangement may comprise an assembly which includes a number of chargeable elements which can be arranged with a voltage source so as to exhibit either a positive or negative bias potential. In a preferred embodiment, the first chargeable element is provided with a negative bias voltage potential and the second chargeable element is provided with a positive bias voltage potential.

The electric field arrangement may comprise an electric dipole field, the field strength of which varies axially and radially relative to the axis of the ion beam flow.

In one embodiment, the assembly includes a first chargeable element which is arranged such that it is provided with a positive or negative bias voltage potential. The assembly may further include a second chargeable element which is arranged such that it is provided with a positive or negative bias voltage potential.

The first and second chargeable elements are sufficiently spaced from one another so as to create an electric field capable of reflecting the ion beam in a predetermined manner. Generally, the intended pathway of the ion beam will flow intermediate of the first and second chargeable elements.

The second chargeable element may comprise an assembly of a number of chargeable members. Each chargeable member may be arranged with a voltage source so as to each be capable of exhibiting a positive voltage or negative voltage bias potential. The voltage potential of each of the chargeable members may vary and be such that the electric field provided between the first and second chargeable elements varies in a manner which facilitates the desired reflection characteristics of the ion beam. Generally, the chargeable members will be provided with a positive voltage potential.

According to another principal aspect of the present invention, there is provided an ion reflector for use with a mass spectrometer for directing a flow of ions between two distinct axes of travel, the reflector including an electric field capable of causing a flow of ions flowing through a first spatial region to flow toward a second spatial region such that the ionic flux at the second spatial region is substantially the same as the ionic flux at the first spatial region, whereby the first and second spatial regions are aligned with respective axes of travel of said ions.

According to another principal aspect of the present invention, there is provided an ion reflector for use with a mass spectrometer for directing a flow of ions between two distinct axes of travel, the reflector comprising an electric field capable of causing a flow of ions flowing through a first spatial region to flow toward a second spatial region so that the energy distribution of the ions flowing through the second spatial region is substantially the same as that flowing through the first spatial region, whereby the first and second spatial regions are aligned with respective axes of travel of said ions.

According to a further principal aspect of the present invention, there is provided a sampling interface for use with mass spectrometry apparatus, the sampling interface arranged so as to enable the sampling of ions in a mass spectrometer, the sampling interface capable of receiving a quantity of ions extracted from an ion source for providing a beam of ions travelling along a first axis of travel and to be directed along an intended pathway toward an ion detector arranged for receiving ions travelling along a second axis of travel, the interface including an ion reflector arranged in accordance with any of the embodiments of the above described principal aspects of the present invention for reflecting the beam of ions between the first and second axes of travel.

The sampling interface may be arranged so as to be associable with at least one of the following mass spectrometry instrumentation: atmosphere pressure plasma ion source (low pressure or high pressure plasma ion source can be used) mass spectrometry such as ICP-MS, microwave plasma mass spectrometry (MP-MS) or glow discharge mass spectrometry (GD-MS) or optical plasma mass spectrometry (for example, laser induced plasma), gas chromotography mass spectrometry (GC-MS), liquid chromotography mass spectrometry (LC-MS), and ion chromotography mass spectrometry (IC-MS). Furthermore, other ion sources may include, without limitation, electron ionization (EI), direct analysis in real time (DART), desorption electro-spray (DESI), flowing atmospheric pressure afterglow (FAPA), low temperature plasma (LTP), dielectric barrier discharge (DBD), helium plasma ionization source (HPIS), desorption atmospheric pressure photo-ionization (DAPPI), and atmospheric description ionization (ADD. The skilled reader will appreciate that the latter list is not intended to be exhaustive, as other developing areas of mass spectrometry may benefit from the principles of the present invention.

According to a further principal aspect of the invention, there is provided a mass spectrometer incorporating any embodiment of the above described ion reflector arranged in accordance with the present invention.

According to another principal aspect of the invention, there is provided an inductively coupled plasma mass spectrometer incorporating any embodiment of the above described ion reflector arranged in accordance with the present invention.

According to another principal aspect of the invention, there is provided an atmospheric pressure ion source mass spectrometer incorporating any embodiment of the above described ion reflector arranged in accordance with the present invention.

According to a further principal aspect of the invention, there is provided a mass spectrometer incorporating any embodiment of the above described sampling interface arranged in accordance with the present invention.

According to another principal aspect of the invention, there is provided an inductively coupled plasma mass spectrometer incorporating any embodiment of the above described sampling interface arranged in accordance with the present invention.

According to another principal aspect of the invention, there is provided an atmospheric pressure ion source mass spectrometer incorporating any embodiment of the above described sampling interface arranged in accordance with the present invention.

According to a further principal aspect of the present invention, there is provided a sampling interface for use with mass spectrometry apparatus, the interface comprising:

an ion focusing device arranged so as to focus ions extracted from an ion source toward a first spatial region; and, an ion reflector having an electric field capable of focusing the flow of ions passing through the first spatial region toward a second spatial region.

The ion reflector may comprise any of the features described in relation to the first, second or third principal aspects of the present invention.

The ion focusing device may comprise any ion thermalising device such as an ion funnel, ion guide or any other device employing residual pressure collision cooling or collisional focusing functionality.

According to another principal aspect of the present invention, there is provided a method for modifying the path of travel of a beam of ions in a mass spectrometer, the method including the step of reflecting ions travelling in a first spatial region from a first focal point in said first spatial region to a second focal point in a second spatial region by applying an electric field to the ions.

According to another principal aspect of the present invention, there is provided a method for modifying the path of travel of a beam of ions in a mass spectrometer, the method including the steps of focusing, at a first focal point in a first spatial region, ions travelling in said first spatial region from an ion source, and reflecting the ions towards a second focal point in a second spatial region by applying an electric field to the ions.

According to another principal aspect of the present invention, there is provided a method for modifying the path of travel of a beam of ions in a mass spectrometer, the method including the steps of focusing, at a first focal point in a first spatial region, ions travelling in said first spatial region from an ion source, and reflecting the ions from one or more incident angles towards a second focal point in a second spatial region by applying an electric field to the ions.

According to another principal aspect of the present invention, there is provided a method for reflecting ions in an ion beam between two distinct axes of travel, the method comprising:

providing an electric, field arrangement for directing a flow of ions through a first spatial region to pass through a second spatial region so that the ionic flux at the first spatial region is substantially the same as the ionic flux at the second spatial region, the first and second spatial regions being aligned with respective axes of travel of said ions.

The method may further comprise the step of directing a flow of ions extracted from an ion source so that the ion flow is focused or concentrated when passing through the first spatial region. This step may be provided by using any ion thermalising device such as an ion funnel, ion guide or any other device employing residual pressure collision cooling or collisional focusing functionality.

The electric field arranged may be appropriately configured so that the energy distribution of the ions at the first spatial region is substantially the same as that at the second spatial region, the first and second spatial regions being aligned with respective first and second axes of travel.

The electric field arrangement may comprise any of the embodiments described in accordance with any of the above described aspects of the present invention.

In the context of the present invention, the term 'reflect', and its variants as used herein, is to be understood to include within its ambit any event or action which might comprise or involve a deflection of ions between two distinct axes of travel.

BRIEF DESCRIPTION OF THE DRAWINGS

Embodiments of the invention will now be further explained and illustrated, by way of example only, with reference to any one or more of the accompanying drawings in which.

DETAILED DESCRIPTION

Figure 1:
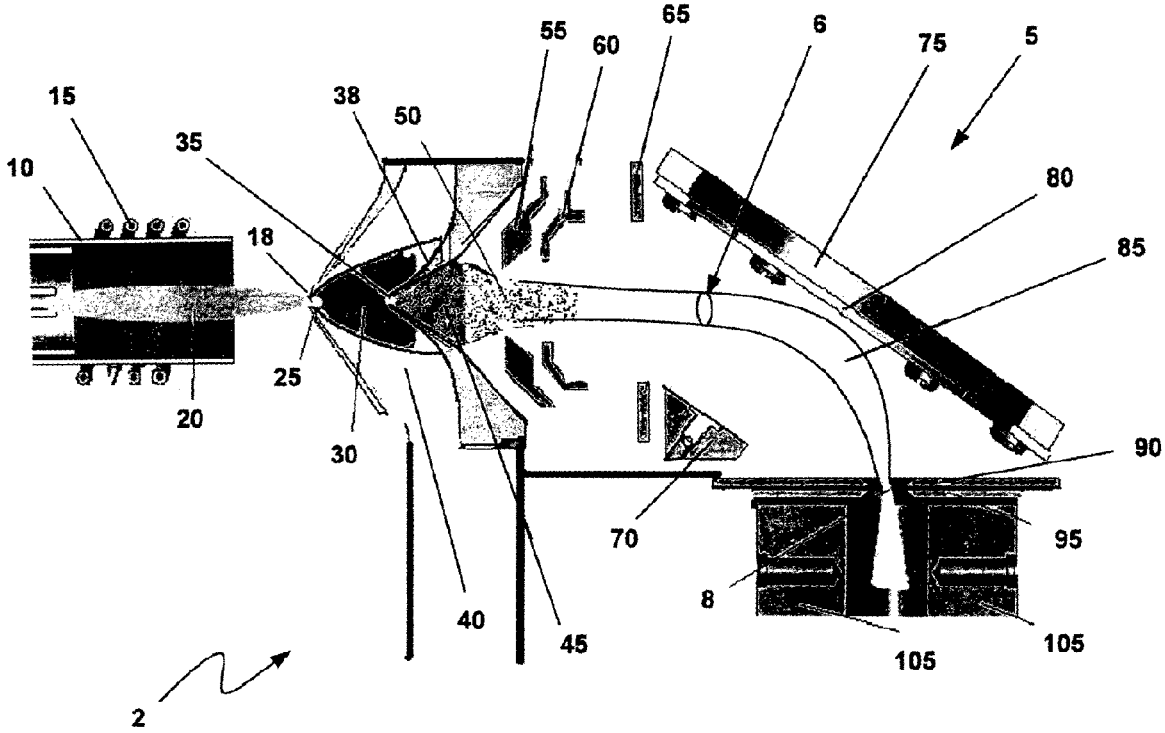
FIG. 1 shows a schematic (plan) view of one embodiment of the present invention.

For brevity, several embodiments of the present invention will be described with specific regard to inductively coupled mass spectrometry (ICP-MS) devices. However, it will be appreciated that the substance of the described embodiments may be readily applied to any mass spectrometry instrumentation, including those having any type of collision atmosphere (including, but not limited to multi-pole collision or reaction cells) arrangements used for selective ion particle fragmentation, attenuation, reaction, collision scattering, manipulation, and redistribution with the purpose of mass-spectra modification. Accordingly, the following mass spectrometry devices may benefit from the principles of the present invention: atmosphere pressure plasma ion source (low pressure or high pressure plasma ion source can be used) mass spectrometry such as ICP-MS, microwave plasma mass spectrometry (MP-MS) or glow discharge mass spectrometry (GD-MS) or optical plasma mass spectrometry (for example, laser induced plasma), gas chromotography mass spectrometry (GC-MS), liquid chromotography mass spectrometry (LC-MS), and ion chromotography mass spectrometry (IC-MS). Furthermore, other ion sources may include, without limitation, electron ionization (EI), direct analysis in real time (DART), desorption electro-spray (DESI), flowing atmospheric pressure afterglow (FAPA), low temperature plasma (LTP), dielectric barrier discharge (DBD), helium plasma ionization source (HPIS), desorption atmospheric pressure photo-ionization (DAPPI), and atmospheric description ionization (ADI). The skilled reader will appreciate that the latter list is not intended to be exhaustive, as other developing areas of mass spectrometry may benefit from the principles of the present invention.

By way of brief explanation, for the case of ICP-MS devices, a 'Campargue' type configuration plasma sampling interface is often utilized to provide for the production and transfer of ions from a test sample to a mass spectrometer. An interface of this configuration generally consists of two electrically grounded components: a first component generally referred to as a sampler (or sampler cone), which is placed adjacent the plasma to serve as an inlet for receiving ions produced by the plasma; and a second component commonly known as a skimmer (or skimmer cone), which is positioned downstream of the sampler so that ions pass therethrough en-route to the mass spectrometer. The skimmer generally includes an aperture through which the ions pass. The purpose of the sampler and skimmer arrangement is to allow the ions to pass (via respective apertures) into a vacuum environment required for operation by the mass spectrometer. The vacuum is generally created and maintained by a multi stage pump arrangement in which the first stage attempts to remove most of the gas associated with the plasma. One or more further vacuum stages may be used to further purify the atmosphere prior to the ions reaching the mass spectrometer. In most systems, an ion optics or extraction lens arrangement is provided and positioned immediately downstream of the skimmer for separating the ions from UV photons, energetic neutrals, and any further solid particles that may be carried into the instrument from the plasma.

Typical ICP mass spectrometers have an ion beam which is extracted from anion source and travels along an intended pathway as a single beam and passes through all the mass spectrometer compartments sequentially. The sample introduction system supplies the ion source with material to be analysed for spectrometric analysis. The ion source is the part of the mass spectrometer device where ions are formed before they are extracted into the ion optics compartment by way of an extractor or interface. The ions may be formed in the plasma or generated by other known means in the art such as for example, under the influence of other particles (electrons, neutrals, ions, photons, chemo ionisation, etc.) or in presence of fields (electrostatic and/or magnetic). Ion sources may operate in different pressure conditions such as atmospheric or other environments having relatively higher or lower pressure conditions.

Most mass spectrometer devices include an ion optics arrangement which is configured to focus and move the ions into an ion beam manipulator (if used) such as any known collision or reaction cell. The purpose of this component is to modify the ion beam by a physical and/or chemical means for specific spectroscopic needs. For example, in the ICP-MS field, providing an 'interference' environment (one containing a specific gas or environment which purposefully interferes with an unwanted particle or particles known to be present in the ion beam) can improve the measurement of a specific kind of 'target' ion which is desired to be measured.

Mass spectrometry can often benefit by using a number of mass-analyzers in sequence and ion beam manipulators of different kinds. Quadrupole mass-analyzers units operate sequentially. The spectra is obtained in sequence allowing only one mass-m/z measurement at a time, and can therefore be time consuming when many masses are needed to be measured. Furthermore, precise isotopic ratio measurements using such sequential methods can be problematic when the ion source and/or sample introduction systems oscillate or flicker, creating unstable (in time) ion beams for subsequent measurement.

Figure 2:
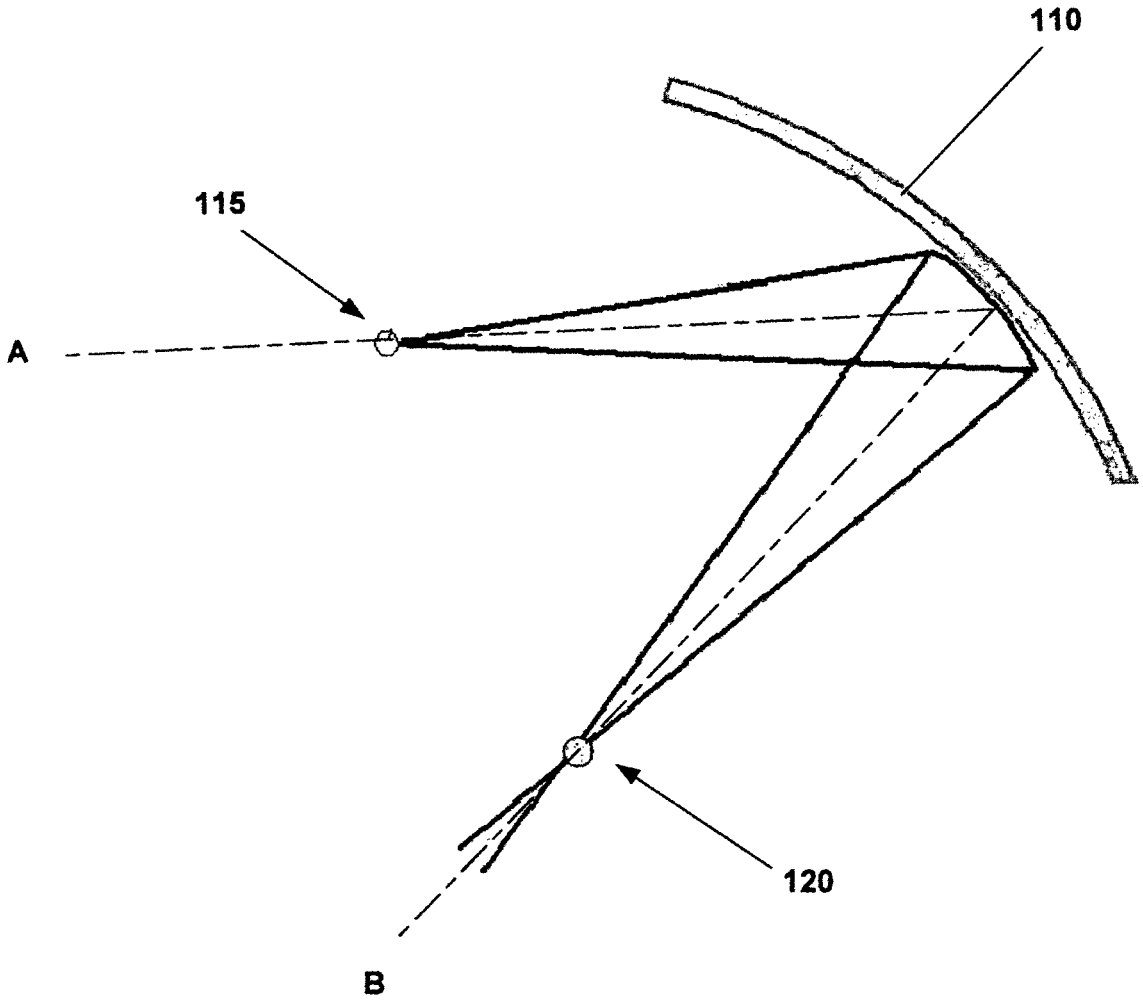
FIG. 2 shows a schematic view of one embodiment of the alignment between the two axes of travel of an ion flow reflected by an ellipsoidally shaped electric field in accordance with one embodiment of the present invention.
Figure 3:
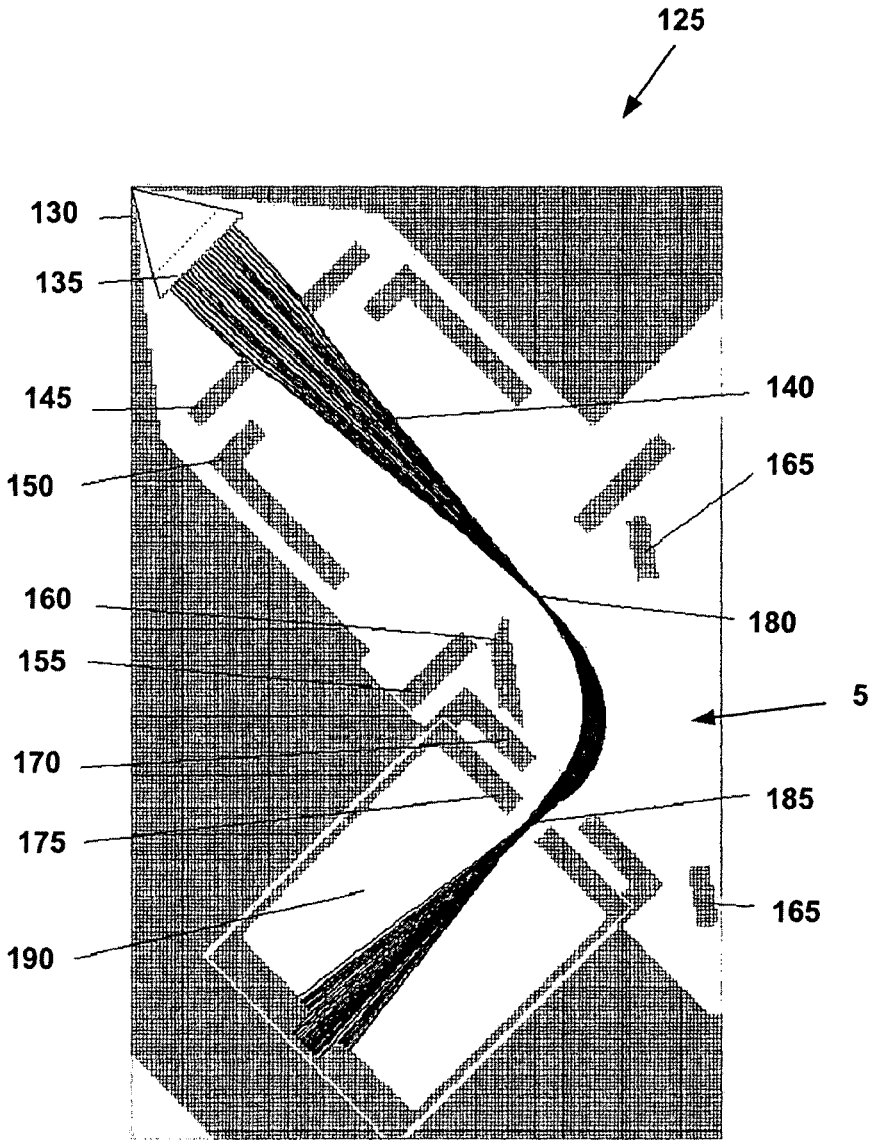
FIG. 3 shows one view of a computer simulation of the ionic flow according to one embodiment of the present invention.
Figure 4:
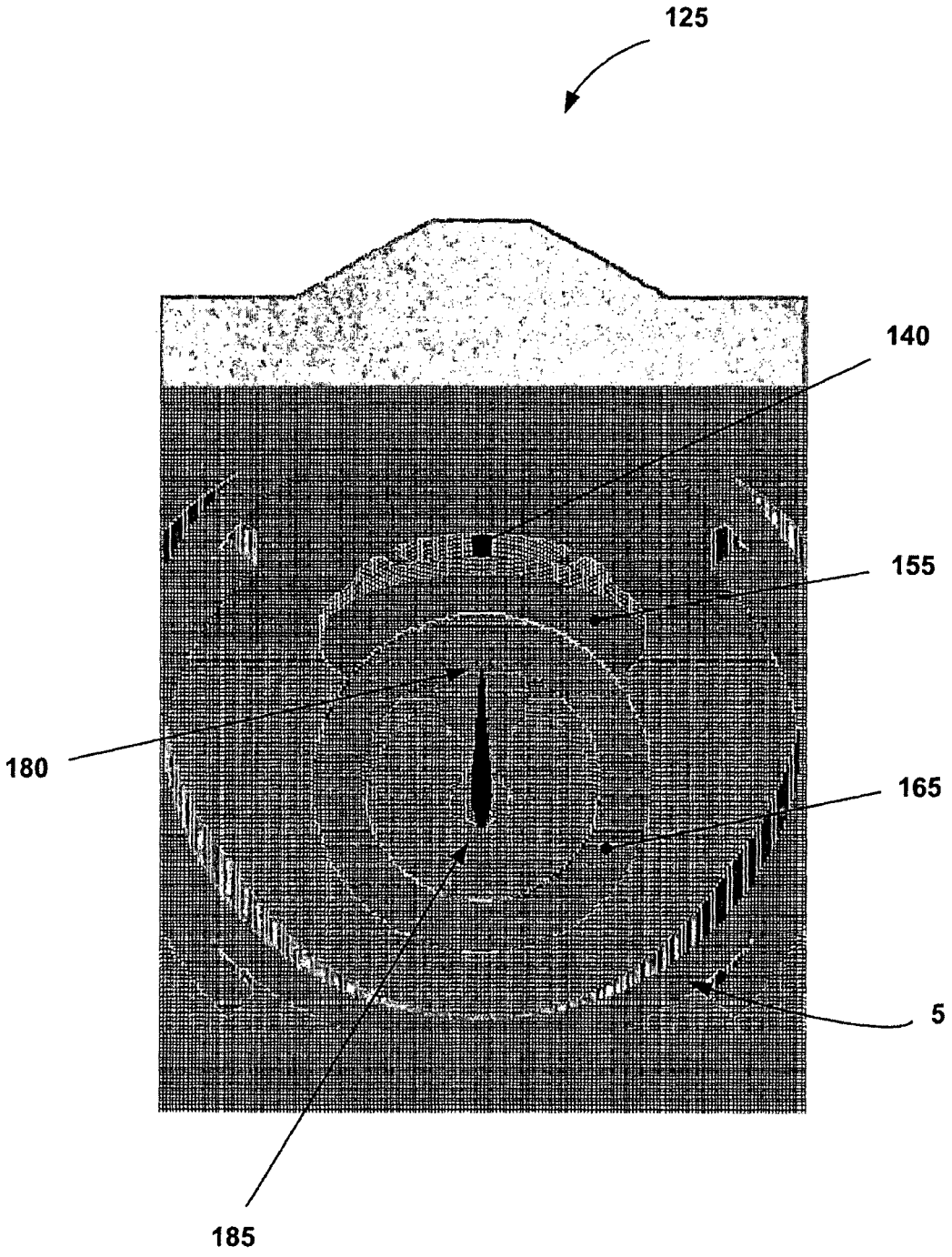
FIG. 4 shows a further view of the computer simulation shown in FIG. 3.
Figure 5:
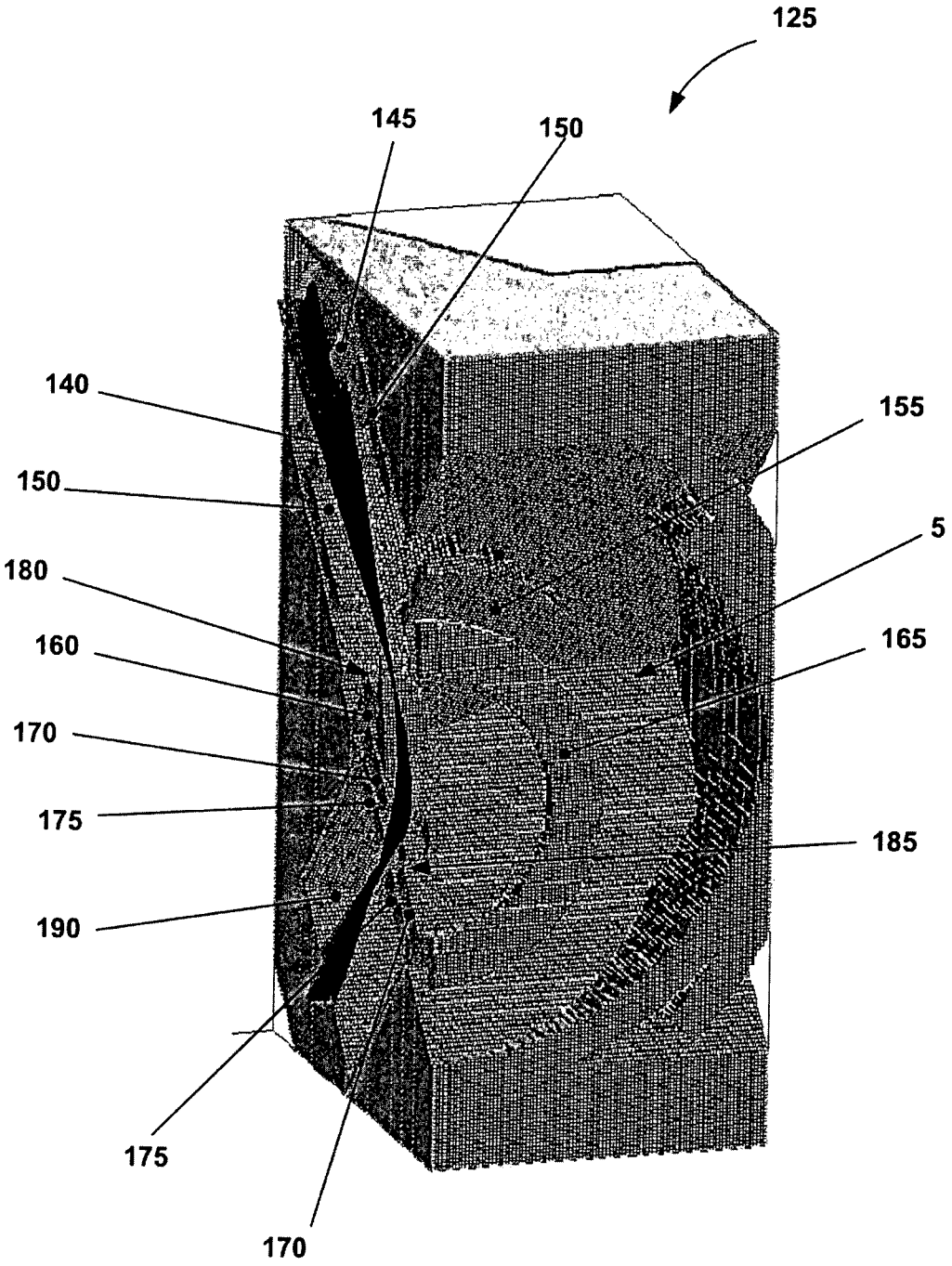
FIG. 5 shows a perspective view of the computer simulation shown in FIG. 3 and FIG. 4.
Figure 6:
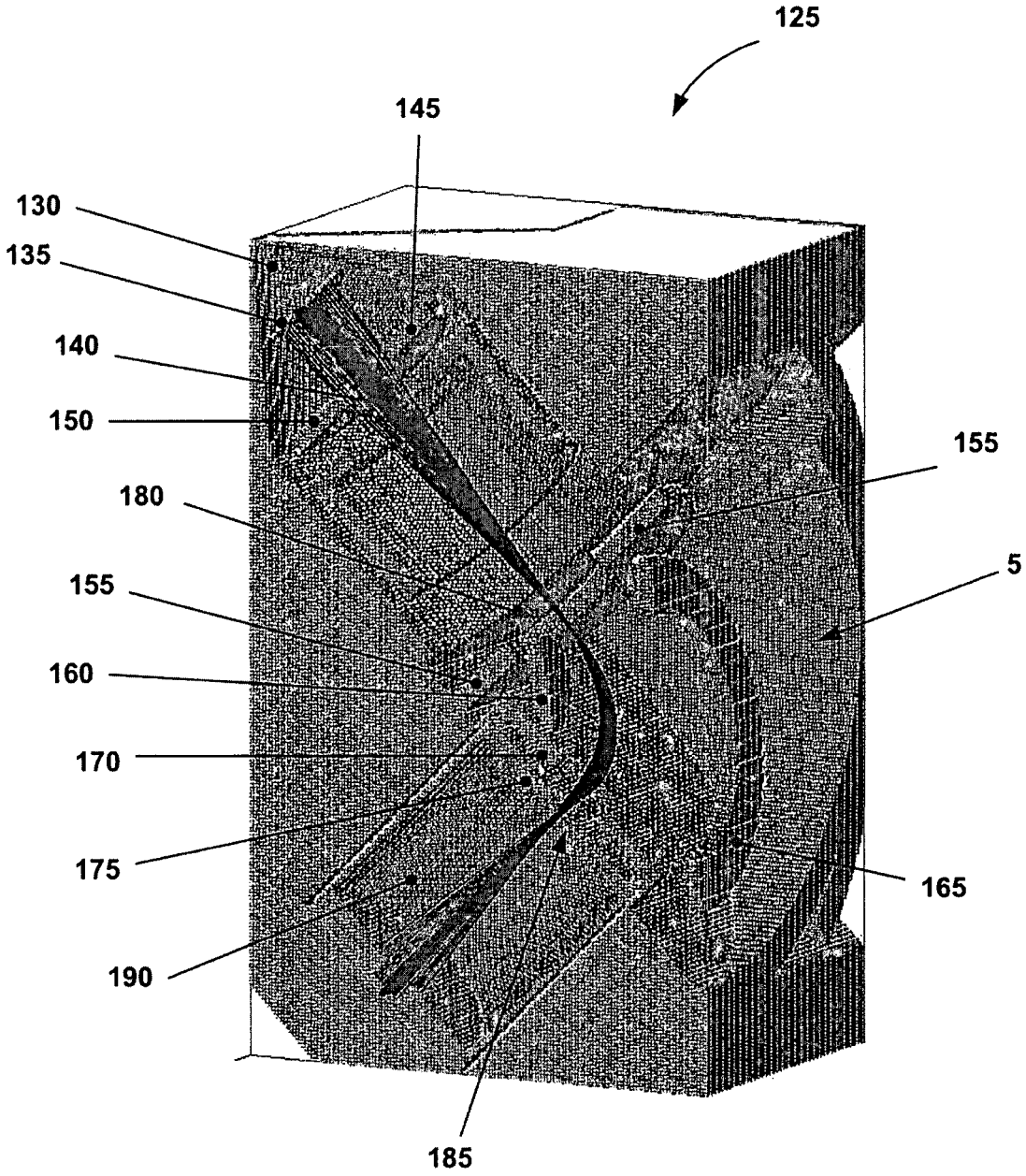
FIG. 6 shows another perspective view of the computer simulation shown in FIGS. 3 to 5.

With reference to FIG. 1 and FIG. 2, one embodiment of an ion reflector 5 arranged in accordance with the present invention is shown for use with a mass spectrometer arrangement 2. The ion reflector 5 is arranged for directing a flow of ions between two distinct axes of travel (A and B shown in FIG. 2). The ion reflector 5 includes an electric field arranged for causing a flow of ions focused toward a first spatial region 6 to be reflected and focused toward a second spatial region 8, whereby the first 6 and second 8 spatial regions are substantially aligned with first A and second B axes of travel respectively.

The mass spectrometer arrangement 2 includes an inductively coupled plasma (ICP) torch 10 having RF coils 15. The ICP torch 10 produces a plasma 20 used to provide a quantity of ions for spectrometric analysis from a specified sample. A sample of ions is extracted from the plasma through an aperture 18 provided in a sampler cone 25 (typically of a dimension of from 0.8-1.5 mm) of a sampling interface. A plasma expansion jet 30 is formed downstream of the sampler cone 25 within a first vacuum chamber 40 (typically having an internal pressure of between 1-10 Torr). The ions then pass through an aperture 35 of a skimmer cone 38 downstream where a further plasma expansion jet 45 forms. From the plasma expansion jet 45 forms an ion beam 50 which passes through extraction lens arrangements 55 and 60. The ion beam 50 is focused toward a further extraction lens 65 which forms part of an ion optics arrangement which includes ion reflector 5.

The first spatial region 6 is representative of a first region of space through which the flow of ions is focused or concentrated toward (ie. a first focal point) so that the ionic flux flowing substantially through the first region of space is maximized and the energy distribution of the ion beam is minimized within that region. The first spatial region 6 is often provided at or near an inlet region through which ions to be sampled or measured by the mass spectrometer are extracted from an ion source.

The focus or concentration of the ions toward the first spatial region 6 can be performed by any ion thermalising device such as an ion funnel, ion guide or any other device employing residual pressure collision(s) cooling or collisional focusing functionality. In this manner, a beam of ions extracted from the ion source can be focused or concentrated so that the ions of the ion beam pass substantially through the first region of space.

The second spatial region 8 generally represents a second region of space toward which ions passing through the first region of space are focused or concentrated (ie. second focal point) by way of the electric field arrangement. The second region of space is preferably provided at or near the entrance of a mass analyzer or collisional cell arrangement which are common components of conventional mass spectrometer devices. In one embodiment, the arrangement defining the electric field is such that the concentration of the ionic flux through the second partial region 8 is substantially the same as the ionic flux through the first spatial region 6. As such, the ionic flux through the first spatial region 6 is substantially mirrored at the second spatial region 8.

Typically, the second spatial region 8 is spatially distinct from the first spatial region 6, whereby the positional relationship between both spatial regions is a function of the specific configuration of the electric field arrangement. In one embodiment, the electric field is arranged so that the second spatial region 8 is spaced sufficiently from the first spatial region 6 so that the ions are reflected between the first A and second B axes of travel (shown in FIG. 2). Preferably, the electric field is arranged so that the position of the second spatial region 8, and therefore the direction of flow of the ions, is predetermined. In this regard, the intended focusing point may be at or near the entrance (having an entrance lens 90 and entrance plate 95) to a mass analyzer having quadrupole pre-filters 105.

It will be appreciated that the relative angle between the first A and second B axes of travel can vary depending upon the mass spectrometry arrangement desired. For example, reflection of the ion beam has been found to increase the measurement sensitivity of the mass spectrometers by reflecting only the target ions thereby removing undesirable particles from the ion beam stream. Such arrangements may therefore avoid the need for collision or reaction cells which generally seek, by way of providing a collisional atmosphere, to improve the target ion density. In addition, the ability to manipulate or steer the ion beam can allow designers flexibility in developing mass spectrometry devices which are more compact and take up less bench space.

The electric field arrangement may comprise an assembly which includes a number of chargeable elements which can be arranged with a voltage source so as to exhibit either a positive or negative potential. The electric field arrangement may comprise an electric dipole field, the field strength of which varies axially and radially relative to the axis of the ion beam flow.

In the preferred embodiment, the shape of the electric field is arranged so that the ion concentration at the first spatial region is mirrored, by way of reflection due to the electric field, at the second spatial region. Preferably, the shape of the electric field is ellipsoidal as shown in FIG. 2.

For the embodiment shown in FIG. 1, the assembly includes a first chargeable element such as corner electrode 70 which is arranged such that it is provided with a negative or positive bias voltage potential. The assembly may further include a second chargeable element 80 which is arranged such that it is provided with a positive or negative voltage bias potential. In the preferred embodiment, the first chargeable element (corner electrode 70) is provided with a negative bias voltage potential and the second chargeable element 80 is provided with a positive bias voltage potential.

The corner electrode 70 and second chargeable element 80 are sufficiently spaced from one another so as to create an electric field capable of generating an ellipsoidal electric dipole field and reflecting (85) the ion beam as appropriate. Generally, the intended pathway of the ion beam will flow between the corner electrode 70 and the second chargeable element 80. The second chargeable element 80 is supported by a hollow plastic base structure 75.

The second chargeable element 80 may comprise an assembly of a number of chargeable members. The members may be arranged with a voltage source so as to each be capable of exhibiting the required bias voltage potential. The voltage potential of each of the chargeable members may vary and be such that the electric field provided between the first and second chargeable elements varies in a manner which facilitates the desired reflection characteristics of the ion beam.

According to a preferred form, the electric field arrangement is configured so as to provide an ellipsoidal shaped electric field (shown in FIG. 2) so as to cause the flow of ions focused toward the first spatial region 6 to be reflected and focused toward the second spatial region 8. In this regard, the ellipsoidal field causes the flow of ions through the first spatial region 6 to flow toward and substantially through the second spatial region 8 such that the ionic flux at the second spatial region 8 is substantially the same as the ionic flux at the first spatial region 6. In this regard, the flow of ions flowing through the first spatial region 6 will flow through the second spatial region 8 so that the energy distribution of the ions flowing through the second spatial region 8 is substantially the same as that flowing through the first spatial region 6.

FIG. 2 shows a schematic view of the reflection of the ion beam due to the ellipsoidally shaped 110 electric field. Ions flow along axis A and are focused toward the first spatial region (or first focal point) 115. The ions continue their trajectory where they encounter the ellipsoidal electric field 110 and are reflected (or repelled) toward the second spatial region (or second focal point) 120 (aligned with axis B) so as to flow therethrough. As shown, axes of travel A and B are spatially distinct from one another.

FIG. 3 to FIG. 6 each show different views of a further embodiment of the present invention which is exemplified as a computer simulation using SIMION modeling software. Mass spectrometer arrangement 125 incorporates an ion reflector arrangement (5) substantially similar to the arrangement shown in FIG. 1. Ions are received by way of inlet 130 and extracting surface 135 so as to provide ion beam 140. The ion beam 140 passes through extraction lens 145 and 150 and is focused so that the ions in the ion beam flow toward first spatial region 180 (first focal point) within extraction lens 155. The ion beam is then reflected by the ellipsoidally shaped electric field produced by corner electrode 160 (first chargeable element) and electrodes 165 (second chargeable element).

As a result of the ellipsoidally shaped electric field, the ion beam is focused toward second spatial region 185 which is at or near extraction lens elements 170 and 175 at the entrance to a mass-analyser 190.

The SIMION modeling of the proposed ion reflector suggests that ions having an energy in the range from 0.1 eV to 10 eV can be appropriately focused toward the second spatial region 185 thereby serving to improve the measurement sensitivity of the spectrometric analysis.

It will be well appreciated that modifications and improvements to the present invention will be readily apparent to those skilled in the art. Such modifications and improvements are intended to be within the scope of this invention.

Examples of a variety of different arrangements which could be configured to incorporate the ion reflector of the present invention are shown in each of FIGS. 7 to 16.

Figure 7:
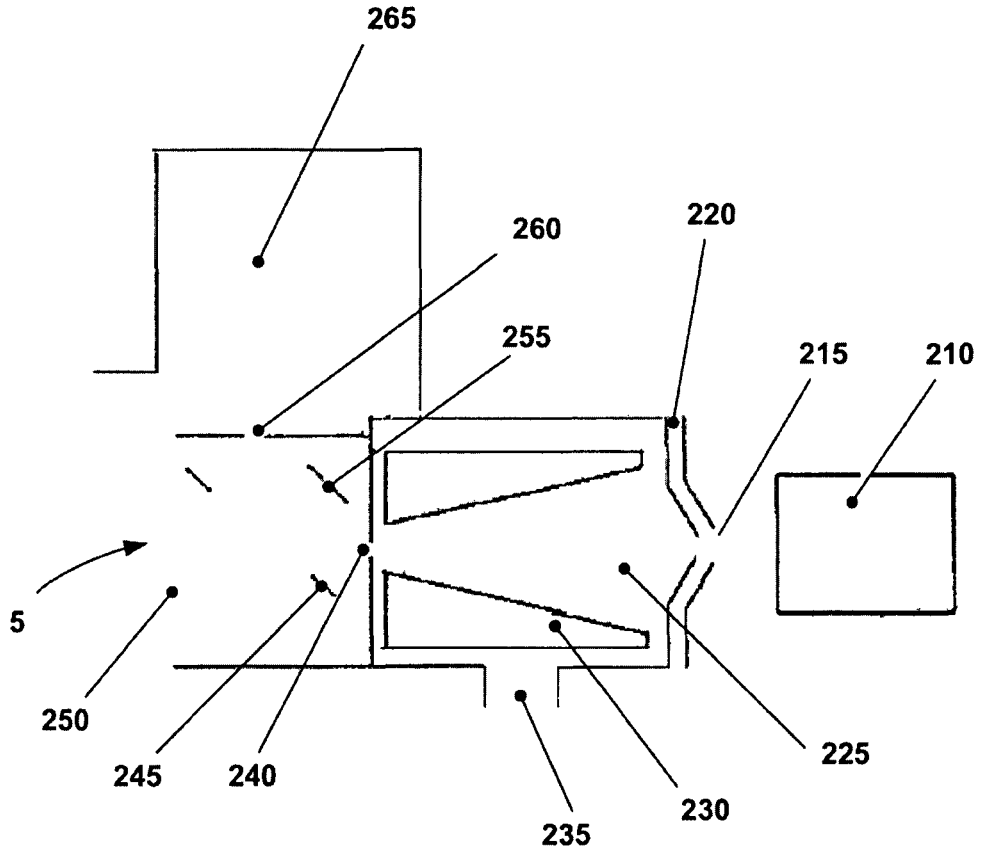
FIG. 7 shows a schematic view of a mass spectrometry arrangement incorporating one embodiment of the present invention.

FIG. 7 shows a mass spectrometry arrangement comprising an ion source 210 from which ions are extracted through inlet 215 and through a curtain gas arrangement 220. The ions then enter a thermalising device (such as an ion funnel, tapered or shaved ion guide) comprising a modified ion guide arrangement 230 which serves to focus the ion beam toward aperture 240 so as to enter an optics arrangement contained within chamber 250. The thermalisation device is contained within chamber 225 which is regulated by pumping port 235. The ion optics arrangement held within chamber 250 comprises an ion reflector arrangement 5 (and ion reflector mirror electrodes 245) configured in accordance with the present invention so as to reflect and focus the ion flow toward the entrance 260 of mass-analyser compartment 265.

Figure 8:
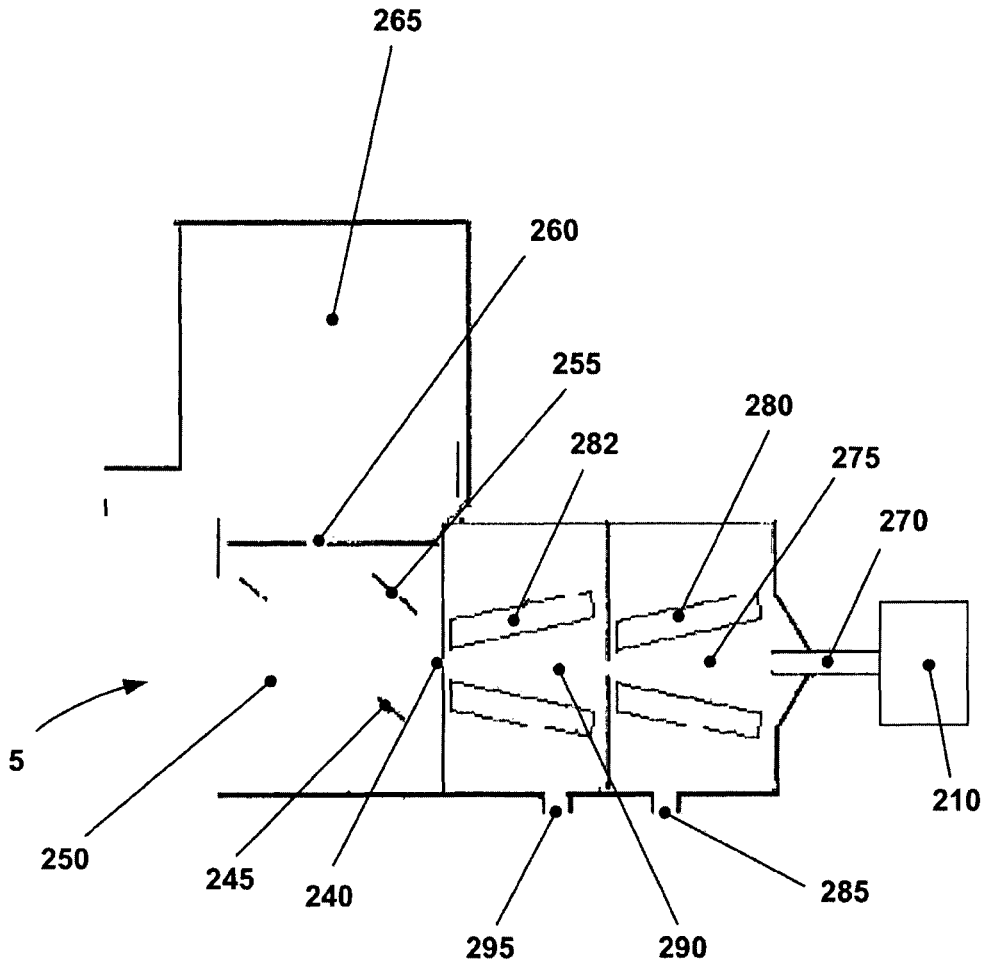
FIG. 8 shows a schematic view of a mass spectrometry arrangement incorporating one embodiment of the present invention.

A similar mass spectrometry arrangement is shown in FIG. 8. However, chamber 225 is replaced by chambers 275 and 290 which contain respective thermalisation devices 280, 282 for refining the beam of ions. The ions are received by chamber 275 by way of an ion capillary or ion transportation device 270 which serves to facilitate ion flow from the ion source 210. Chambers 275 and 290 are each regulated by pumping ports 285 and 295 respectively.

Figure 9:
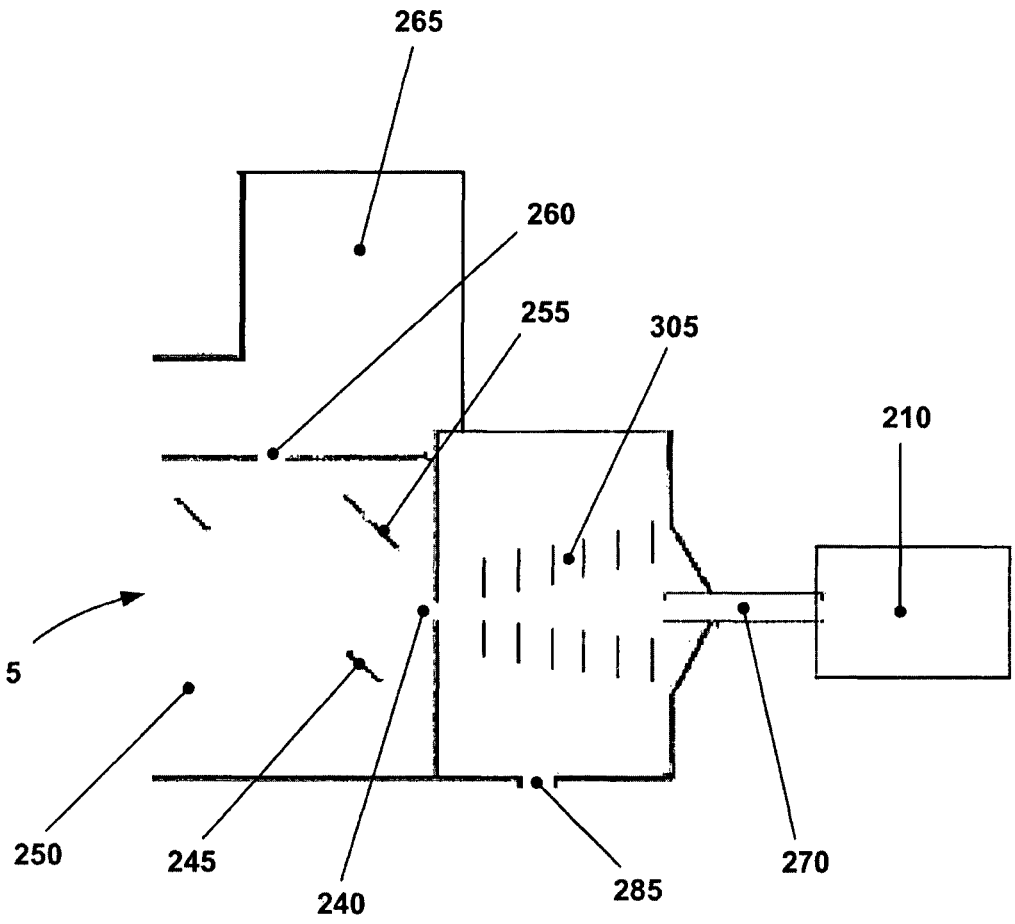
FIG. 9 shows a schematic view of another mass spectrometry arrangement incorporating an embodiment of the present invention.
Figure 10:
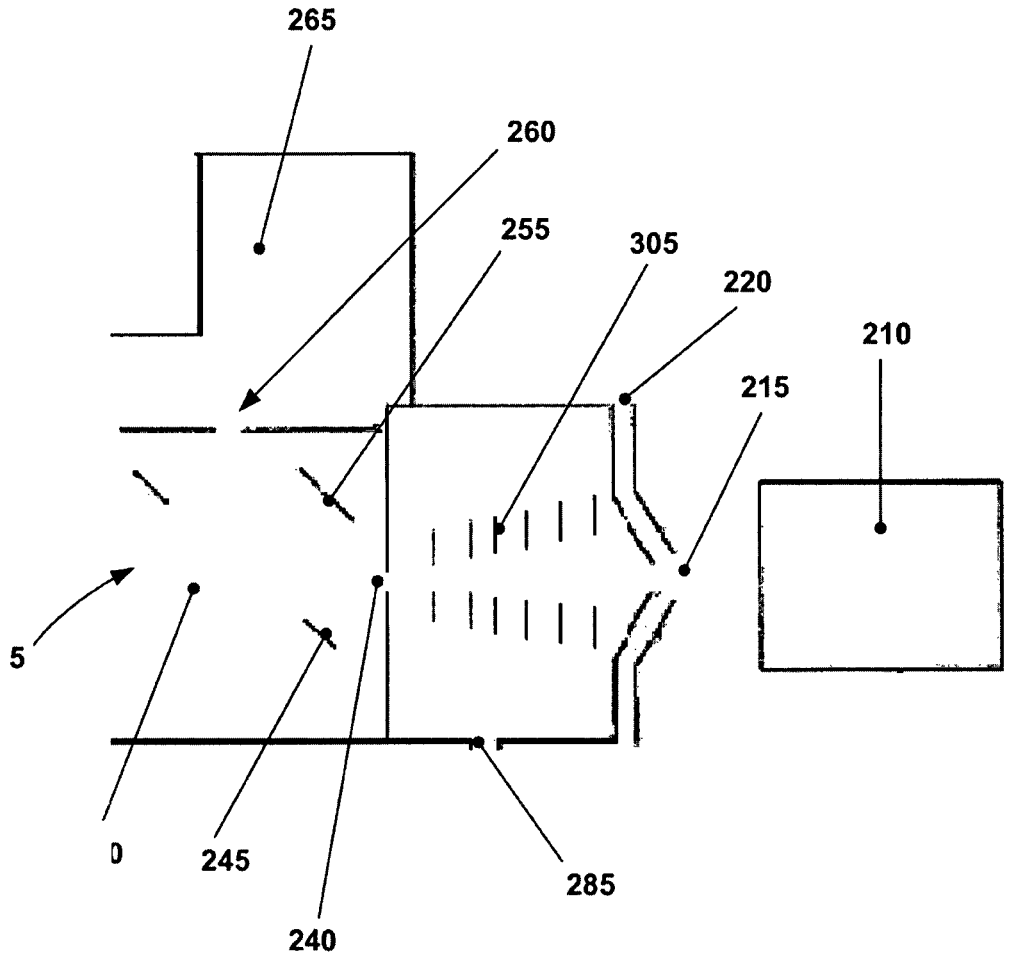
FIG. 10 shows a schematic view of a further mass spectrometry arrangement incorporating an embodiment of the present invention.
Figure 11:
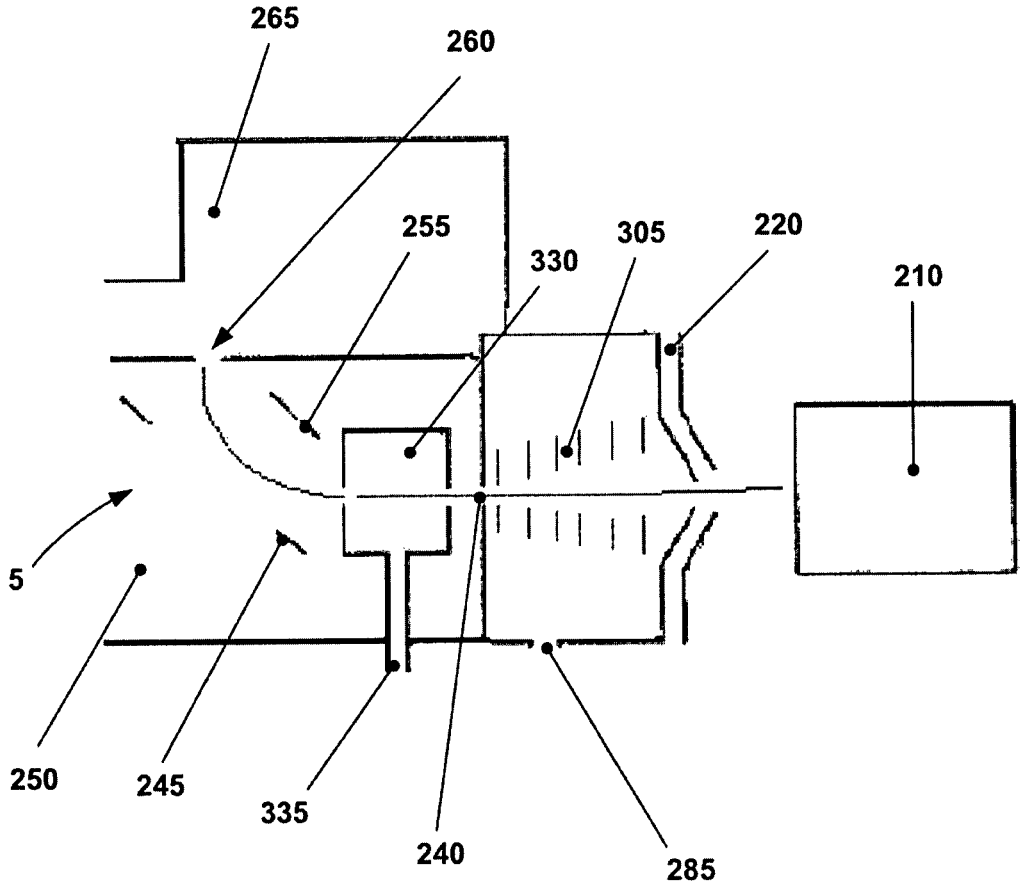
FIG. 11 shows a schematic view of a further mass spectrometry arrangement incorporating an embodiment of the present invention.

A further mass spectrometry arrangement is shown in FIG. 9 which retains similar structure to that shown in FIG. 7. The arrangement shown employs a single thermalisation device 305 which receives ions using the ion capillary or ion transportation device 270. The arrangement shown in FIG. 10 retains the thermalisation device 305 but is instead configured downstream of the gas curtain arrangement 220 (shown in FIG. 7).

The mass spectrometry arrangements shown in FIGS. 11 to 14 can also be arranged so as to incorporate a collisional or reaction cell 330 which is placed between the thermalisation device 305 and the ion reflector arrangement 5. In the case of a conventional ICP-MS configuration, when a collision or reactive gas is used in a CRI atmosphere, a reduction in sensitivity due to collisional scatter can be observed to be in the order of from 10-100 times during operation. The or each collision cell may be arranged so as to accommodate one or more reaction or collision gases (via gas inlet port 335) such as ammonia, methane, oxygen, nitrogen, argon, neon, krypton, xenon, helium or hydrogen, or mixtures of any two or more of them, for reacting with ions extracted from the plasma. It will be appreciated that the latter examples are by no means exhaustive and that many other gases, or combinations thereof, may be suitable for use in such collision cells.

Figure 12:
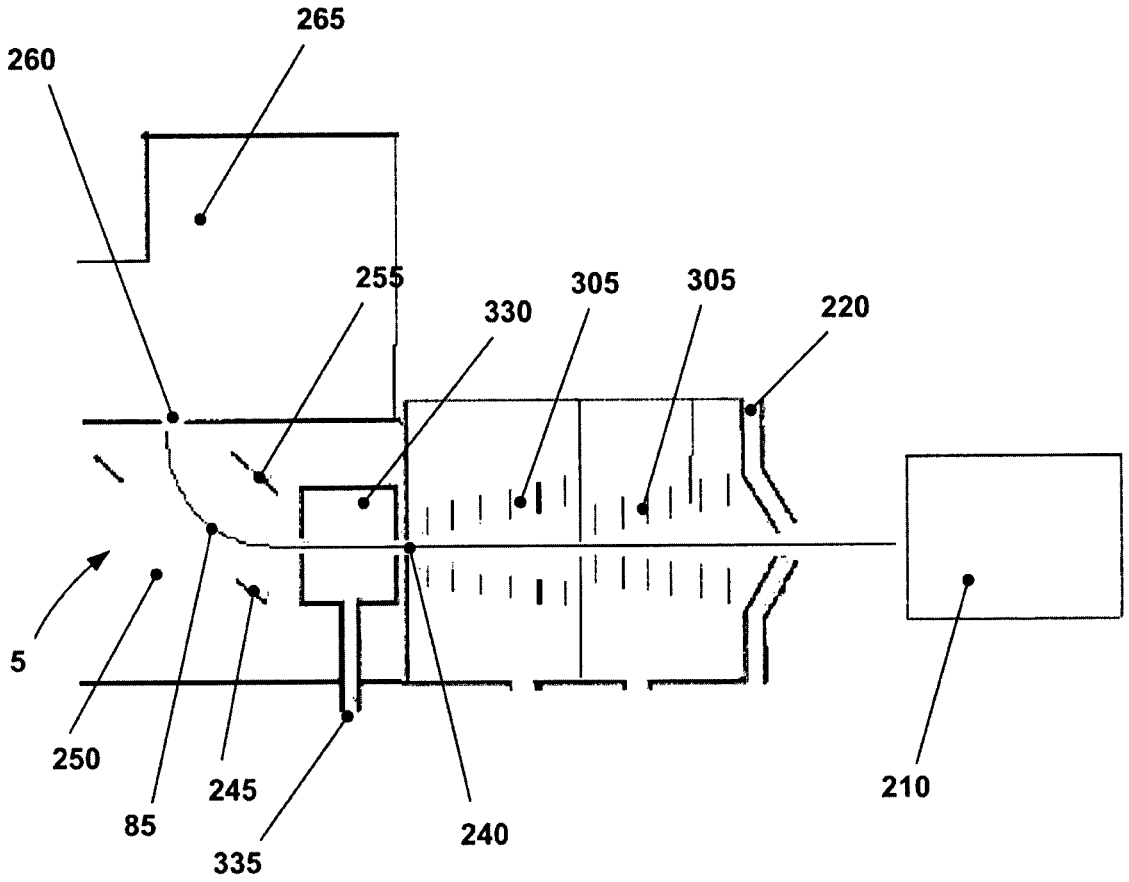
FIG. 12 shows a schematic view of a further mass spectrometry arrangement incorporating an embodiment of the present invention.

FIG. 12 shows a mass spectrometry arrangement where two thermalisation devices 305 are placed in series following receipt of ions through gas curtain 220.

Figure 13:
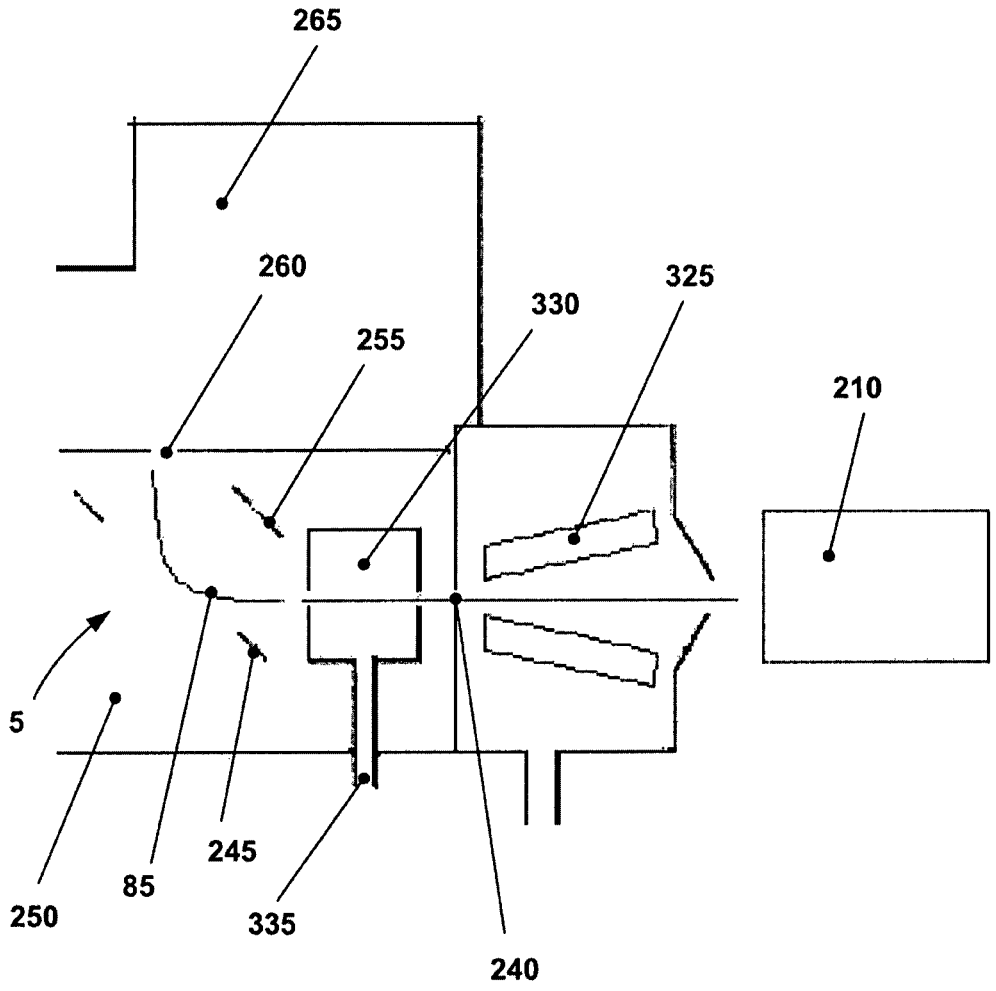
FIG. 13 shows a schematic view of a further mass spectrometry arrangement incorporating an embodiment of the present invention.
Figure 14:
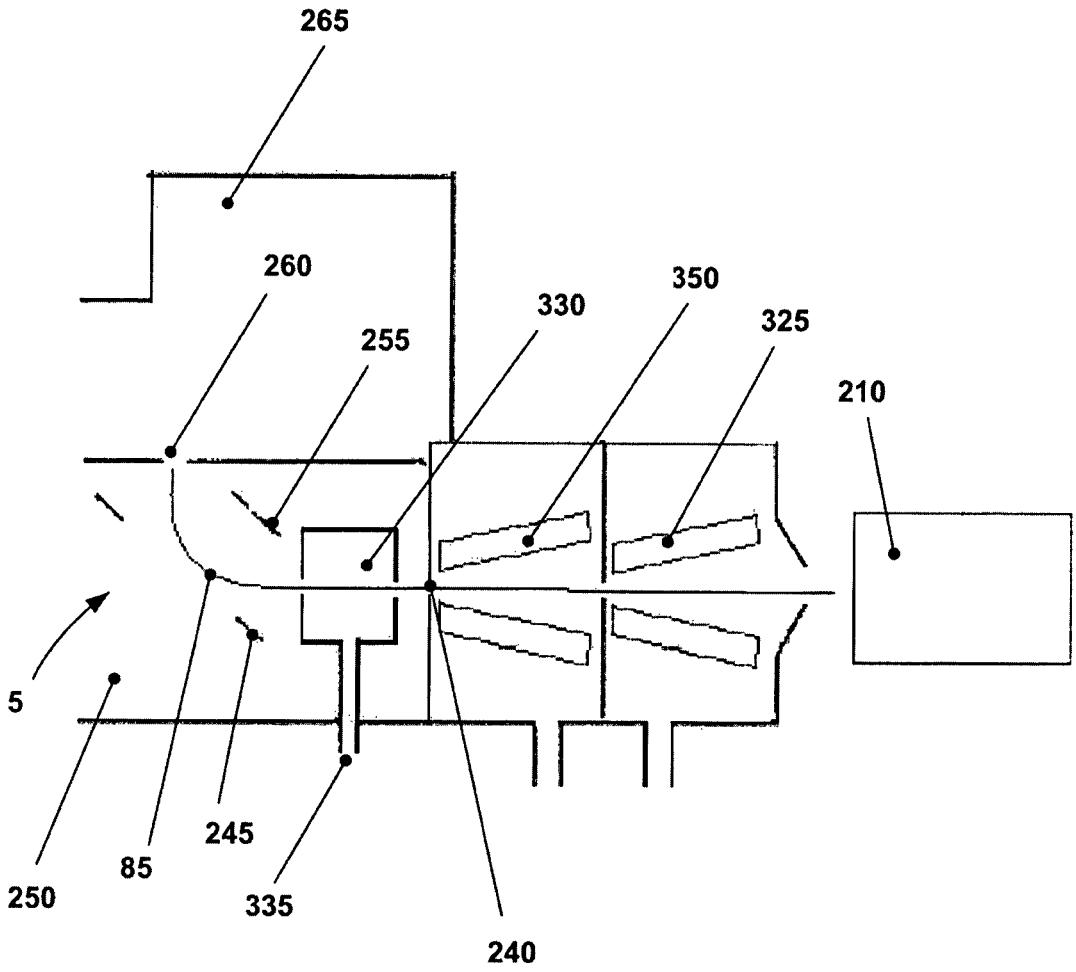
FIG. 14 shows a schematic view of a further mass spectrometry arrangement incorporating an embodiment of the present invention.

FIG. 13 shows a mass spectrometry arrangement in which the thermalisation arrangement is configured with shaved or tapered guide elements, and FIG. 14 shows the case where a series arrangement of two such thermalisation configurations is incorporated.

Figure 15:
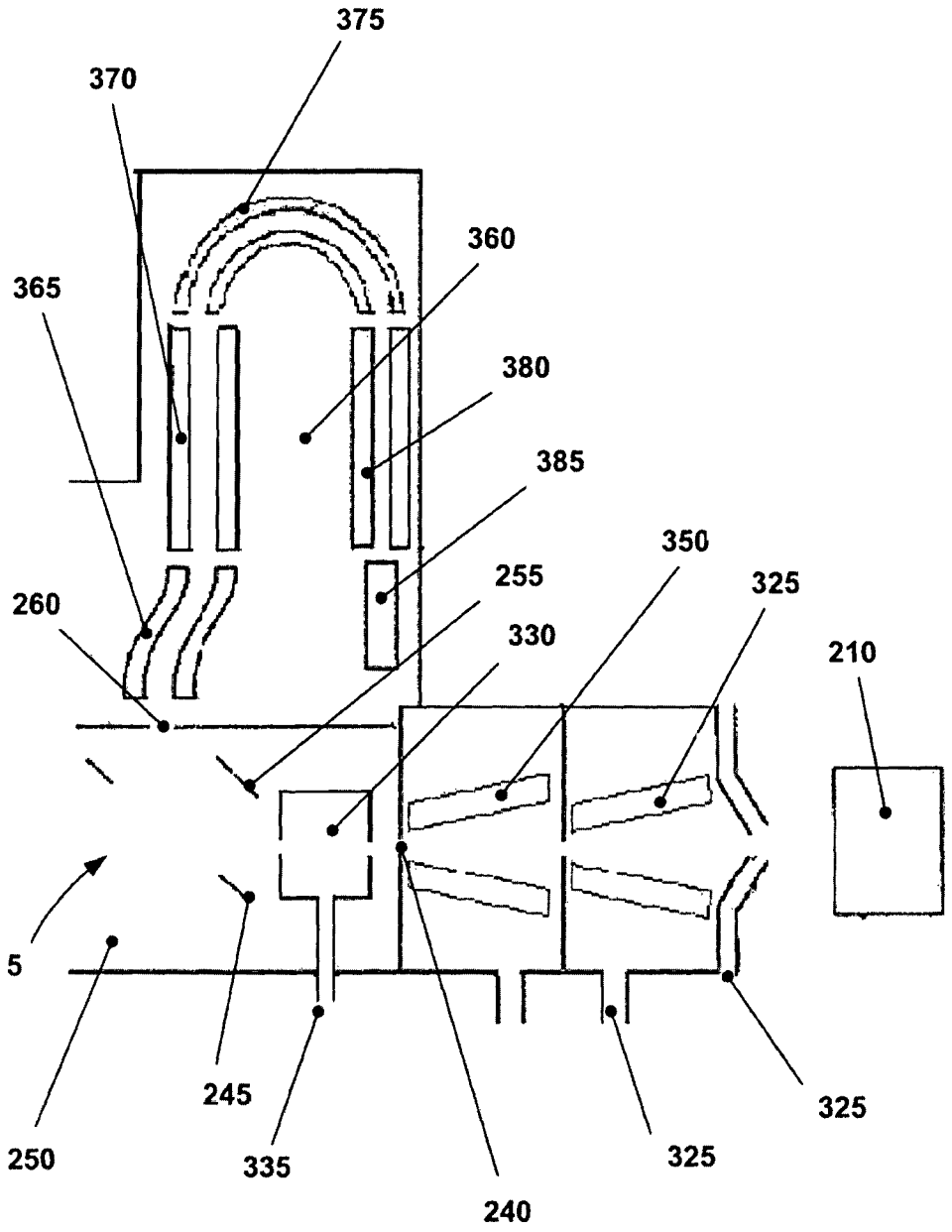
FIG. 15 shows a schematic view of a further mass spectrometry arrangement incorporating an embodiment of the present invention; and, FIG. 16 shows a schematic view of a further mass spectrometry arrangement incorporating an embodiment of the present invention.
Figure 16:
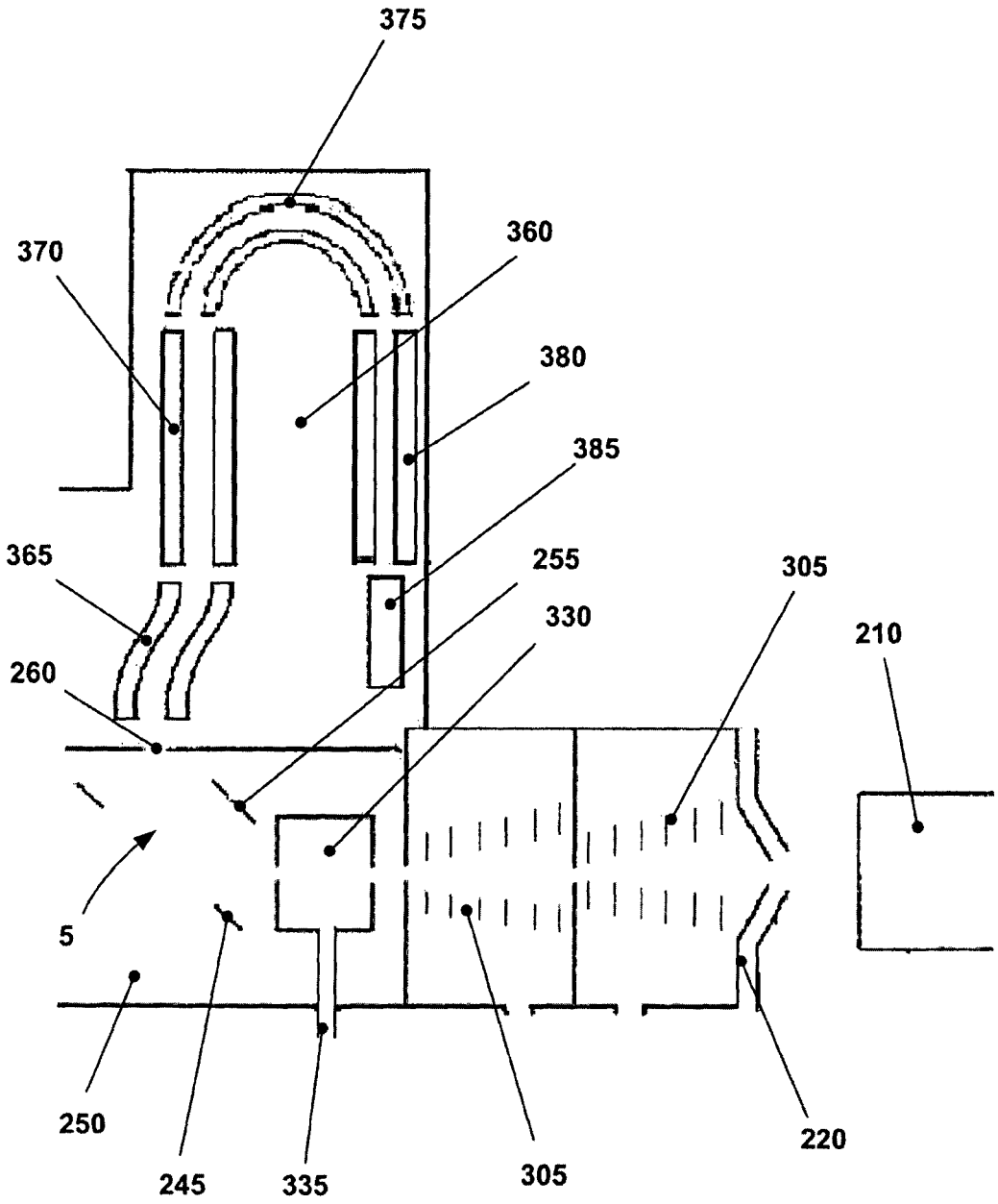

It will be appreciated that additional mass filter arrangements may be used to further refine the ion beam once it has been reflected by the ion reflector 5. FIGS. 15 and 16 each show a mass spectrometry arrangement employing previously shown versions of the thermalisation arrangement downstream of the gas curtain 220. The ion beam is however reflected to the entrance of a triple quadrupole mass analyser arrangement 360. The mass-analyser arrangement 360 comprises a pre-filter arrangement 365 comprising an assembly of curved fringing rods which guides the ion beam toward a first quadrupole mass analyser 370. The ion beam is then passed into collision cell 375 before entering a second quadrupole mass-analyser 380 which then guides the ion beam ultimately to the ion detector unit 385.

The skilled person will appreciate that the arrangements shown in FIGS. 7 to 16 are not intended to be exhaustive but merely serve to demonstrate how the principles of the ion reflector of the present invention may be readily deployed in different mass spectrometry arrangements. Other variations will be readily apparent to those skilled in the art.

The word 'comprising' and forms of the word 'comprising' as used in this description and in the claims does not limit the invention claimed to exclude any variants or additions.

The invention claimed is:

1. An ion reflector for use with a mass spectrometer for directing a flow of ions between two distinct axes of travel, the reflector including an electric field capable of causing a flow of ions flowing through a first spatial region to flow toward a second spatial region such that the ionic flux at the second spatial region is substantially the same as the ionic flux at the first spatial region, whereby the first and second spatial regions are aligned with respective axes of travel of said ions.

2. The ion reflector according to claim 1, wherein the flow of ions can be concentrated or focused toward the first spatial region by an ion thermalising device such as an ion funnel, ion guide or other like device employing residual pressure collision cooling or collisional focusing functionality, so that a beam of ions extracted from the/an ion source can be focused or concentrated so that they pass substantially through the first region of space.

3. The ion reflector according to claim 1, wherein the second spatial region represents a second region of space toward which ions passing through the first region of space are focused or concentrated by way of the electric field arrangement.

4. The ion reflector according to claim 1, wherein the second region of space is provided at or near the entrance of a mass analyzer or collisional cell arrangement.

5. The ion reflector according to claim 1, wherein the arrangement of the electric field is such that the concentration of the ionic flux through the second partial region is substantially the same as the concentration of ionic flux through the first spatial region.

6. The ion reflector according to claim 1, wherein the electric field arrangement is configured so that the ionic flux through the first spatial region is substantially mirrored at the second spatial region.

7. The ion reflector according to claim 1, wherein a shape of the electric field is substantially ellipsoidal.

8. The ion reflector according to claim 1, wherein the electric field is arranged so that the ions are reflected between first and second axes of travel which are aligned substantially 90 degrees from one another.

9. The ion reflector according to claim 1, wherein the electric field arrangement comprises an electric dipole field, the field strength of which, varies axially and radially relative to the axis of the ion beam flow.

10. The ion reflector according to claim 1, wherein the electrical field arrangement comprises an assembly which includes a number of chargeable elements which can be arranged with a voltage source so as to exhibit either a positive or negative bias potential.

11. The ion reflector according to claim 10, wherein the assembly comprises first and second chargeable elements, wherein the first chargeable element is provided with a negative bias voltage potential and the second chargeable element is provided with a positive bias voltage potential.

12. The ion reflector according to claim 11, wherein the first and second chargeable elements are sufficiently spaced from one another so as to create an electric field capable of reflecting the ion beam in a predetermined manner.

13. The ion reflector according to claim 11, wherein the second chargeable element comprises an assembly of a number of chargeable members, the or each chargeable member being arranged with a voltage source so as to each be capable of exhibiting a positive voltage or negative voltage bias potential.

14. The ion reflector according to claim 13, wherein the voltage potential of each of the chargeable members is variable, and arranged such that the electric field provided between the first and second chargeable elements varies in a manner which facilitates the desired reflection characteristics of the ion beam.

15. The ion reflector according to claim 13, wherein each of the chargeable members are provided with a positive voltage potential.

16. A sampling interface for use with mass spectrometry apparatus, the sampling interface arranged so as to enable the sampling of ions in a mass spectrometer, the sampling interface capable of receiving a quantity of ions extracted from an ion source for providing a beam of ions travelling along a first axis of travel and to be directed along an intended pathway toward an ion detector arranged for receiving ions travelling along a second axis of travel, the interface including an ion reflector according to claim 1 for reflecting the beam of ions between the first and second axes of travel.

17. A method for reflecting ions in an ion beam between two distinct axes of travel, the method comprising:

providing an electric field arrangement for directing a flow of ions through a first spatial region to pass through a second spatial region so that the ionic flux at the first spatial region is substantially the same as the ionic flux at the second spatial region, the first and second spatial regions being aligned with respective axes of travel of said ions.

18. The method according to claim 17, further comprising the step of directing a flow of ions extracted from an ion source so that the ion flow is focused or concentrated when passing through the first spatial region.

19. The method according to claim 18, wherein the step of directing a flow of ions extracted from the ion source is provided by using an ion thermalising device such as an ion funnel, ion guide or other like device employing residual pressure collision cooling or collisional focusing functionality.

20. The method according to claim 17, wherein the electric field is appropriately configured so that the energy distribution of the ions at the first spatial region is substantially the same as that at the second spatial region, the first and second spatial regions being aligned with respective first and second axes of travel of said ions.

* * * * *